US011676556B2

(12) United States Patent
Calayir et al.

(10) Patent No.: US 11,676,556 B2
(45) Date of Patent: Jun. 13, 2023

(54) ROW CROSSTALK MITIGATION

(71) Applicant: APPLE INC., Cupertino, CA (US)

(72) Inventors: Vehbi Calayir, Santa Clara, CA (US); Rodrigo Calderon Rico, Cupertino, CA (US); Bret Rothenberg, Los Altos, CA (US); Chengrui Le, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/647,126

(22) Filed: Jan. 5, 2022

(65) Prior Publication Data

US 2022/0215812 A1 Jul. 7, 2022

Related U.S. Application Data

(60) Provisional application No. 63/134,328, filed on Jan. 6, 2021.

(51) Int. Cl.

| | |
|---|---|
| ***G09G 3/36*** | (2006.01) |
| ***G09G 3/3283*** | (2016.01) |
| ***G09G 3/3291*** | (2016.01) |

(52) U.S. Cl.

CPC ..... *G09G 3/3688* (2013.01); *G09G 3/3283* (2013.01); *G09G 3/3291* (2013.01); *G09G 2320/0209* (2013.01)

(58) Field of Classification Search

None

See application file for complete search history.

(56) References Cited

U.S. PATENT DOCUMENTS

| | | | | |
|---|---|---|---|---|
| 5,670,973 | A * | 9/1997 | Bassetti, Jr. | G09G 3/3685 345/100 |
| 7,777,708 | B2 | 8/2010 | Drader et al. | |
| 8,248,393 | B2 | 8/2012 | Hekstra et al. | |
| 8,982,184 | B2 | 3/2015 | Damera-Venkata et al. | |
| 10,714,020 | B1 * | 7/2020 | Zhang | G09G 3/3216 |
| 11,205,363 | B2 | 12/2021 | Choi et al. | |
| 2010/0295844 | A1 * | 11/2010 | Hayashi | G09G 3/3666 345/214 |
| 2012/0044275 | A1 * | 2/2012 | Kobayashi | G09G 3/20 345/690 |
| 2017/0039967 | A1 * | 2/2017 | Jung | G09G 3/3406 |

FOREIGN PATENT DOCUMENTS

| | | | | |
|---|---|---|---|---|
| CN | 108877707 | A * | 11/2018 | |
| CN | 110992911 | A * | 4/2020 | G09G 3/36 |
| CN | 111061107 | A * | 4/2020 | G02F 1/13624 |

* cited by examiner

*Primary Examiner* — Kirk W Hermann

(74) *Attorney, Agent, or Firm* — Kilpatrick Townsend & Stockton LLP

(57) ABSTRACT

A method and light-emitting diode (LED) device configured to compensate for crosstalk between rows of the LED device.

12 Claims, 13 Drawing Sheets

Replacement Drawing display system, tablet computer, mobile phone, augmented reality display, notebook computer, computer display, or digital watch 200

Replacement Drawing display system, tablet computer, mobile phone, augmented reality display, notebook computer, computer display, or digital watch 200

ROW CROSSTALK MITIGATION

CROSS-REFERENCES TO RELATED APPLICATION

This application claims the benefit of U.S. Provisional Application No. 63/134,328, filed Jan. 6, 2021 entitled "Row Crosstalk Mitigation," the disclosure which is incorporated by reference herein in its entirety.

BACKGROUND

Field

Aspects of the disclosure relate in general to displays. Aspects include a method and light-emitting diode (LED) device configured to compensate for crosstalk between rows of the LED device.

Description of the Related Art

An organic light-emitting diode (OLED or Organic LED) display is a video display that uses a light-emitting diode (LED) in which the emissive electroluminescent layer is a film of organic compound that emits light in response to an electric current.

Pixel elements within a OLED display are commonly organized into rows and columns.

SUMMARY

Embodiments include light-emitting diode device configured to compensate for crosstalk between rows of the LED device.

In one embodiment, an apparatus comprises a light emitting diode (LED) display panel, a row driver, and switching circuitry. The light emitting diode (LED) display panel comprises a plurality of light emitting pixels divided into rows. The rows of light emitting pixels each is further divided into at least one region. The row driver is configured to receive image data from a graphics-processing unit. The row driver is configured to compensate for crosstalk between the rows of light emitting pixels, and to output crosstalk compensated image data. The switching circuitry is configured to receive the crosstalk compensated image data and configured to route the crosstalk compensated image data to the display panel for display. The apparatus may be a tablet computer, mobile phone, augmented reality display, notebook computer, computer display, or digital watch.

In a non-transitory computer-readable storage medium embodiment, shown in FIG. 7, the storage medium is encoded with data and instructions to be executed by a computer on an apparatus. The apparatus comprises a light emitting diode (LED) display panel, a row driver, and switching circuitry. The light emitting diode (LED) display panel comprises a plurality of light emitting pixels divided into rows. The rows of light emitting pixels each further divided into at least one region. The row driver is configured to receive image data from a graphics-processing unit. The row driver is configured to compensate for crosstalk between the rows of light emitting pixels, and to output crosstalk compensated image data. The switching circuitry is configured to receive the crosstalk compensated image data and configured to route the crosstalk compensated image data to the display panel for display. The light-emitting diode display panel may be incorporated in a tablet computer, mobile phone, augmented reality display, notebook computer, computer display, or digital watch.

BRIEF DESCRIPTION OF THE DRAWINGS

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evident to the contrary from the description, where elements in different figures use identical reference numbers, the elements are generally either identical or at least similar in function or purpose.

DETAILED DESCRIPTION

Embodiments describe light-emitting diode display panel designs and methods of operation, which compensate for crosstalk between rows of a light emitting diode display device, particularly at lower brightness backlight levels.

Figure 1B:
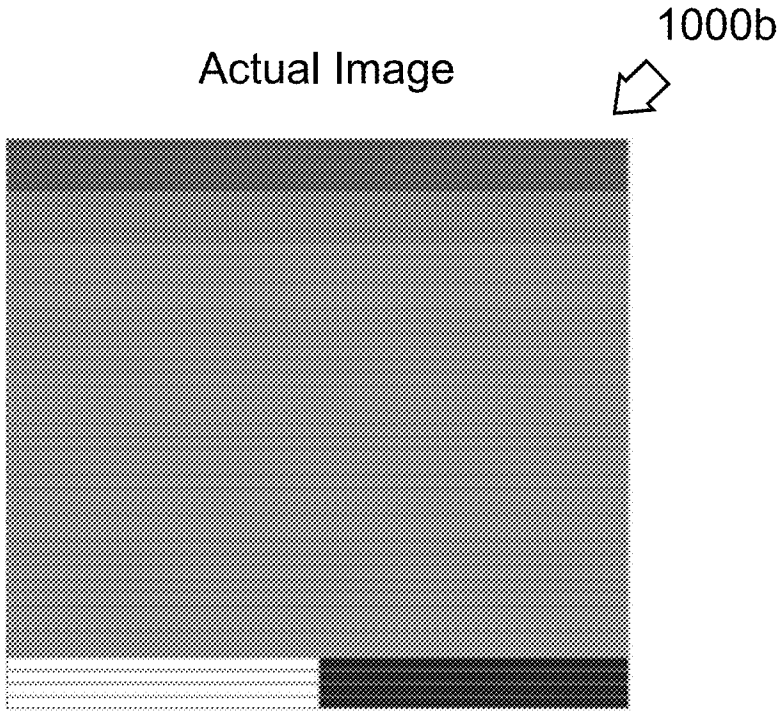
FIGS. 1A-1B illustrate observed desired display and actual display images.
Figure 1A:
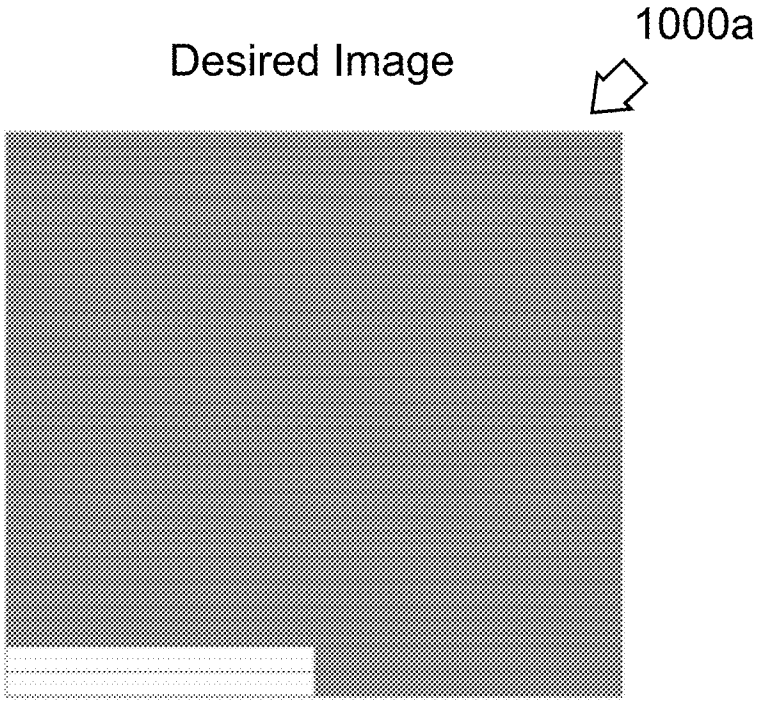

In one aspect, as shown in FIGS. 1A and 1B, it has been observed that a desired image 1000*a* may be rendered improperly at lower brightness backlight levels, and is particularly noticeable in static images. The initial rows of an actual image 1000*b* may be rendered darker than the desired image 1000*a* when certain patterns are displayed. An example worst-case image is having a white area with a grey background, as seen in the bottom rows of the desired image 1000*a*. This can result in a much darker rendered actual image 1000*b*. For example, in the rows where there is a highlight low grey background is impacted the most by both IR drops and voltage transients. Due to memory effect via storage capacitors supply voltage does not recover immediately and subsequent rows starting from top of the display are also darker while power supply is recovering although IR drop is substantially lower. The amount of how dark subsequent rows are depends on how fast power supply recovers from load transients. It should also be noted that rows are scanned in a round-robin fashion.

Another aspect of the disclosure is the discovery that these undesirable front of screen (FoS) row artifacts result from LED voltage ($V_{LED}$) variation caused by row current changes, including voltage transients and current-resistance (IR) voltage drops from row driver routing and switching resistance from the row voltage power supply. Variation in the LED anode voltage causes a change in LED turn-on time, which directly relates to the total photons generated. As there is a single feeding circuit to the complete set of rows, the feeding circuit holds memory from the previous row when feeding the next row. The time to discharge is not sufficient under specific scenarios. There is a loss of charge to the luminance up, and voltage at the end of previous slots affects the actual image 1000*b*.

Figure 2:
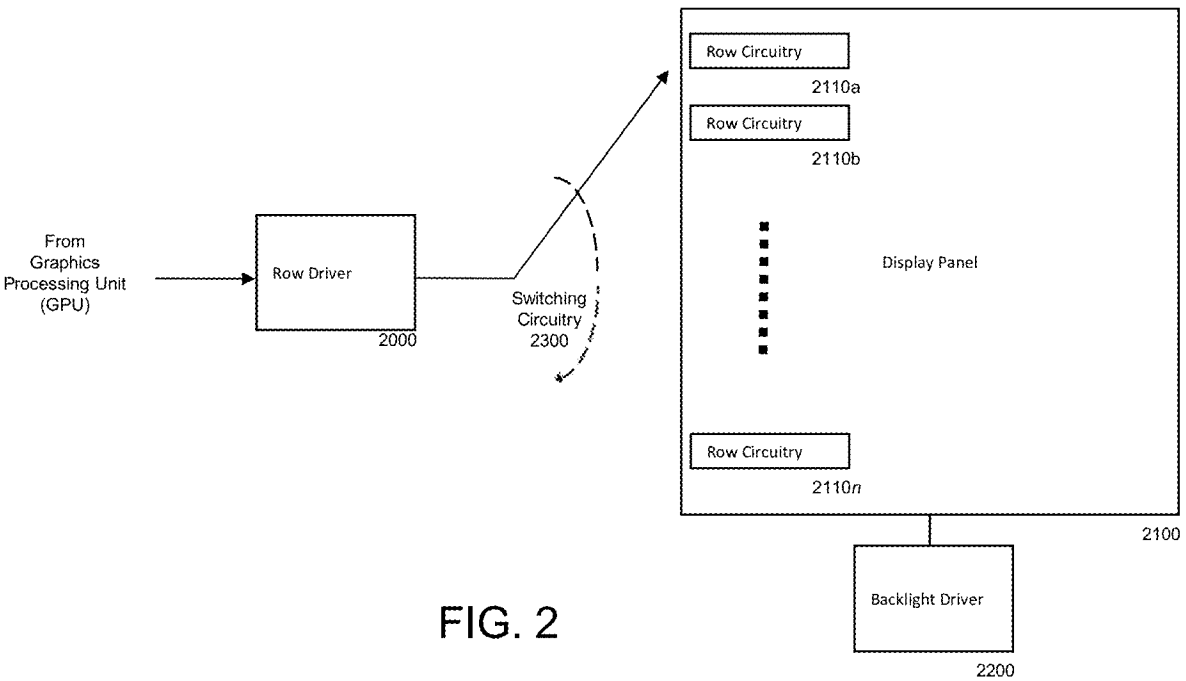
FIG. 2 is a block diagram of a display system embodiment configured to provide compensation for crosstalk between rows of the LED device.

FIG. 2 is a block diagram of a display system 200, in accordance with an embodiment of the present disclosure. It is understood by those familiar with the art that the system described herein may be implemented in a variety of hardware or firmware solutions. In this embodiment, a display system 200 comprises a row driver 2000, switching circuitry 2300, and display panel 2100. Additionally, some embodiments may include a backlight driver 2200.

Display system 200 may be a stand-alone display, or: a computer display, television set, notebook computer, tablet computer, mobile phone, smartphone, augmented reality display, digital "smart" watch, or other digital device. Row driver 2000 is configured to receive an image frame from a graphics-processing unit (not shown) and compensate for crosstalk between rows of a light emitting diode display panel 2100.

Figure 6:
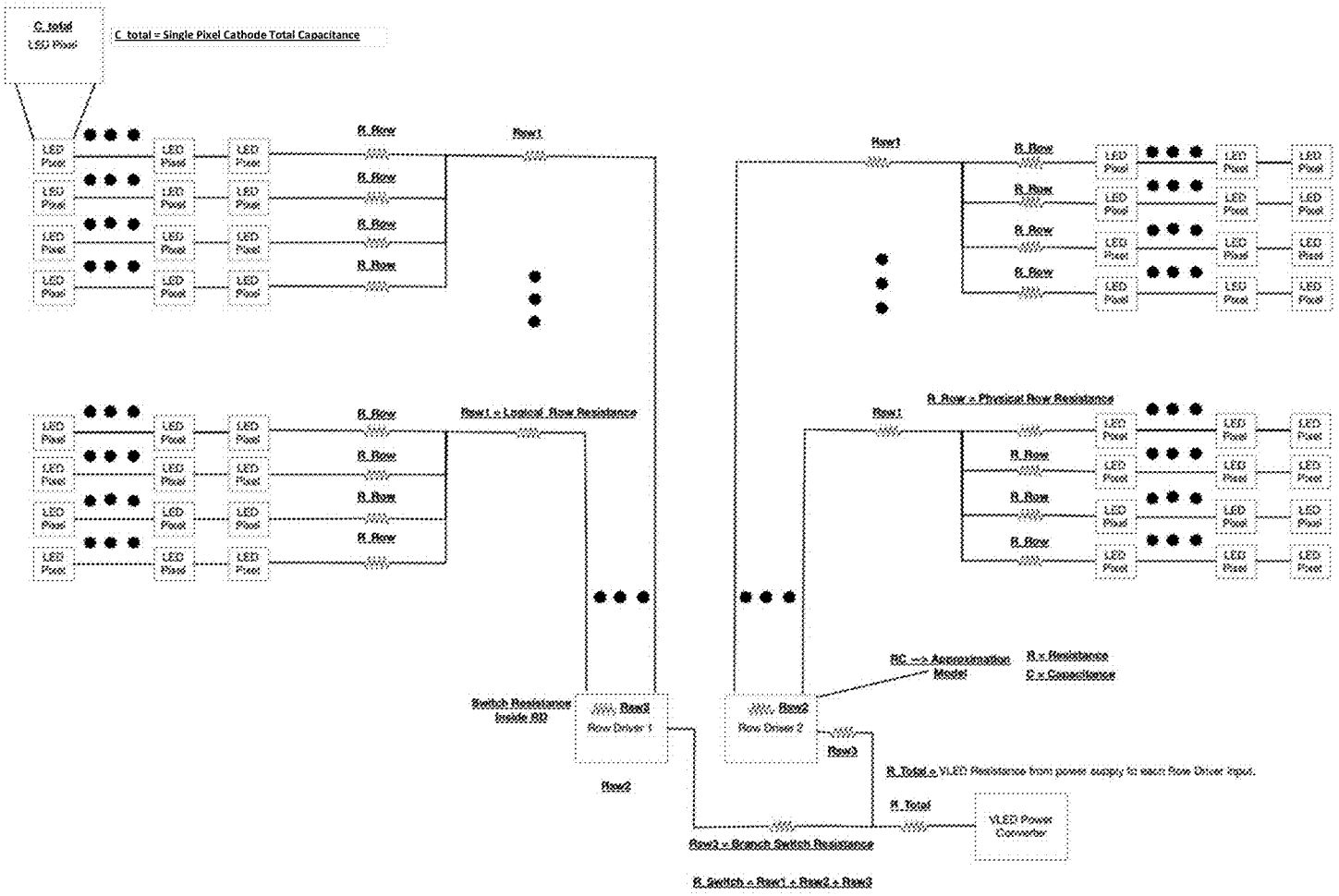
FIG. 6 is a block diagram of a display panel embodiment configured to provide full compensation for crosstalk between rows of the LED device.

As shown in FIG. 6, the display panel 2100 may be an organic light-emitting diode (OLED) display, such as a passive-matrix (PMOLED) or active-matrix (AMOLED). In other embodiments, the display panel 2100 may be a micro-light emitting diode (micro-LED) display. Light emitting pixels of display panel 2100 are organized into rows (lines) and columns. A LED pixel may consist of one or more LEDs. Each row comprises row circuitry 2110*a-n* (where n is the number of pixel rows). Additionally, each row can be divided into LED regions. Embodiments described by this disclosure divide a row into two regions—left and right; other embodiments may divide a row into a different number of regions. For the purposes of this disclosure, row circuitry 2110 comprises pixel circuitry to drive display pixels in each row.

In this embodiment, a row driver 2000 receives image data from a graphics-processing unit; the row driver 2000 compensates for crosstalk between the rows and outputs crosstalk compensated image data to switching circuitry 2300. The crosstalk compensation is described in greater detail below. Switching circuitry 2300 routes the crosstalk compensated image data to the appropriate region of LED pixels 2110*a-n* for display on display panel 2100.

In some embodiments, a backlight driver 2200 is present.

Figure 3:
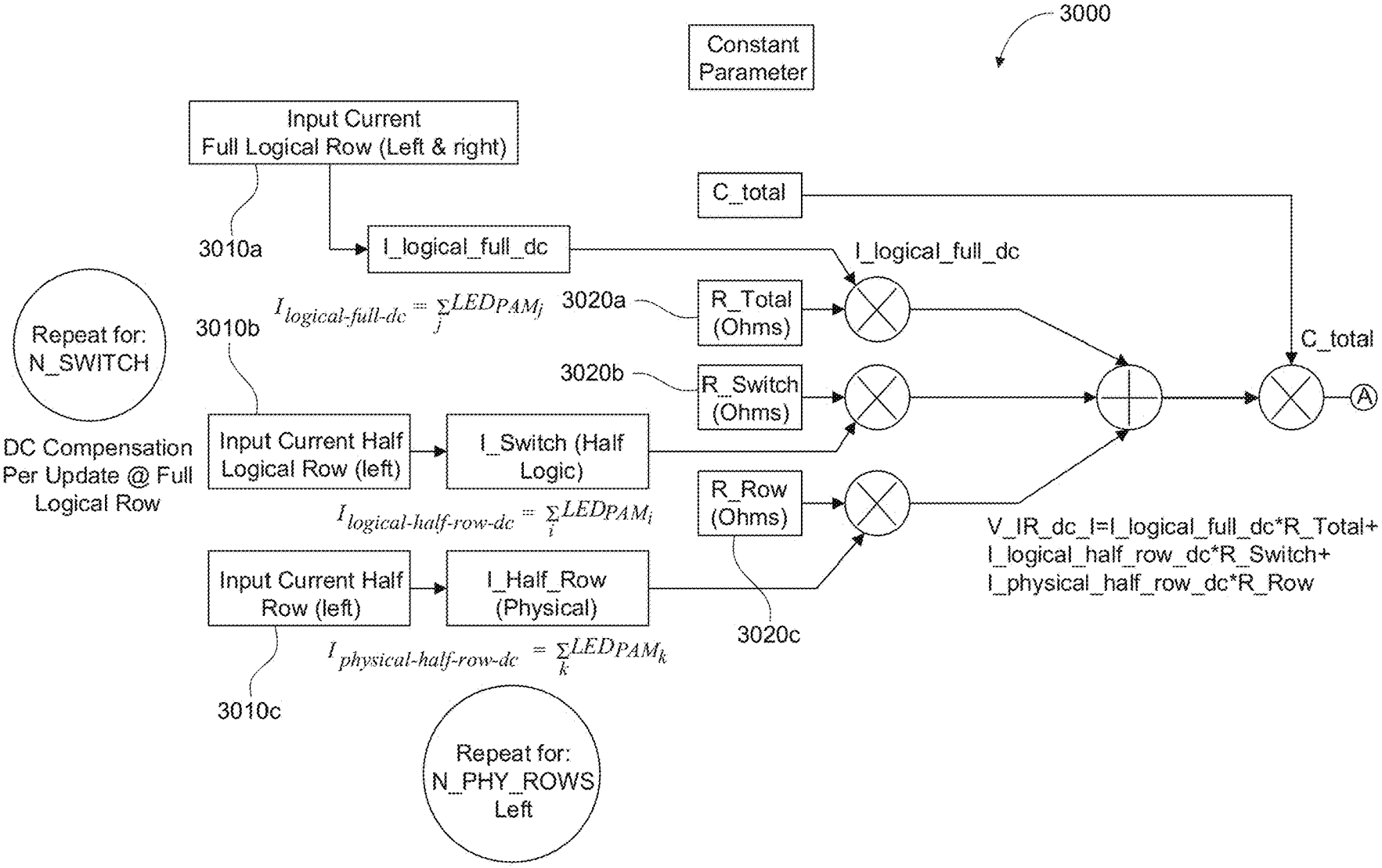
FIG. 3 is a block diagram of a row driver embodiment configured to provide direct current compensation for crosstalk between rows of the LED device.
Figure 3:
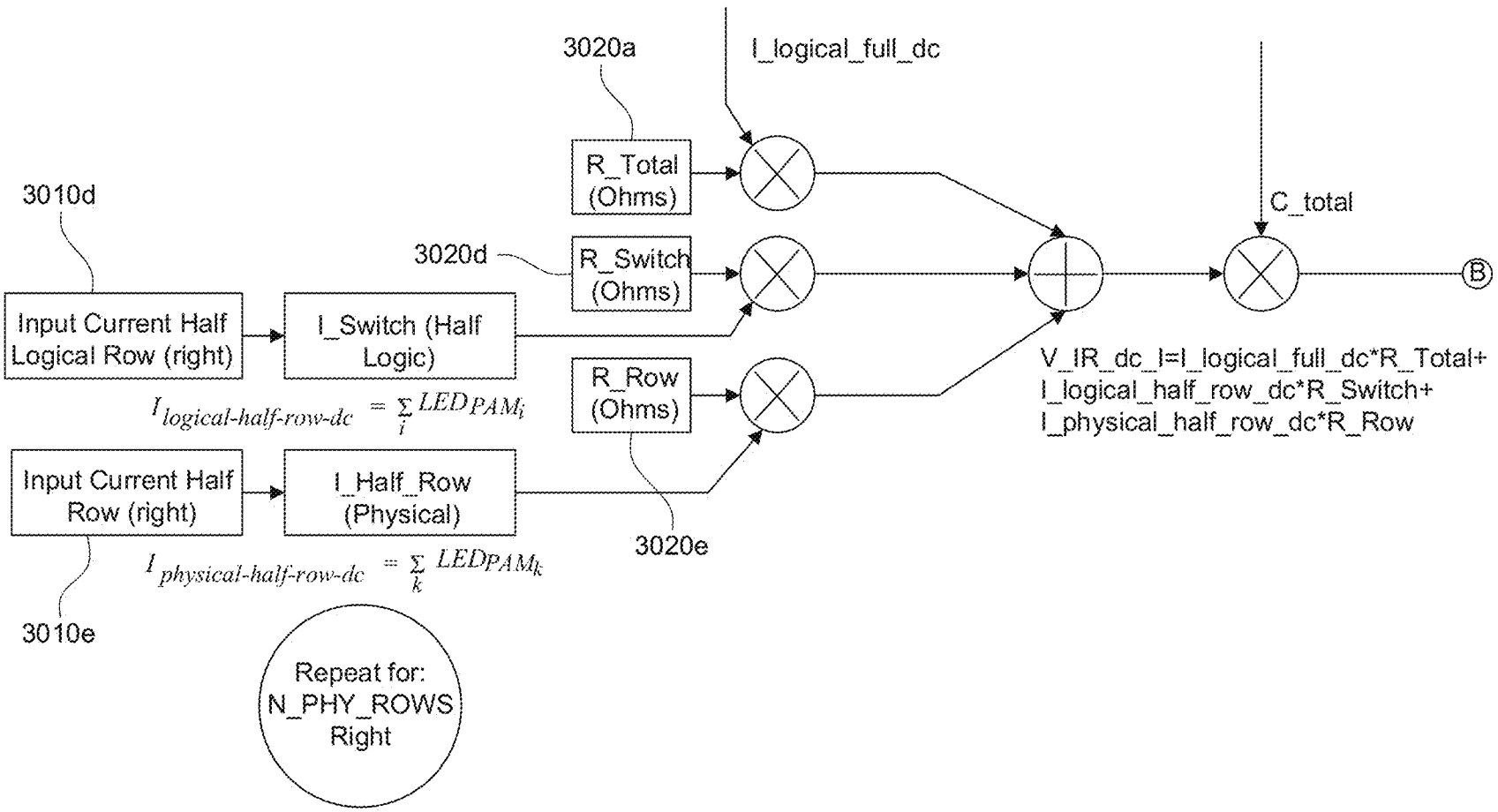
Figure 3:
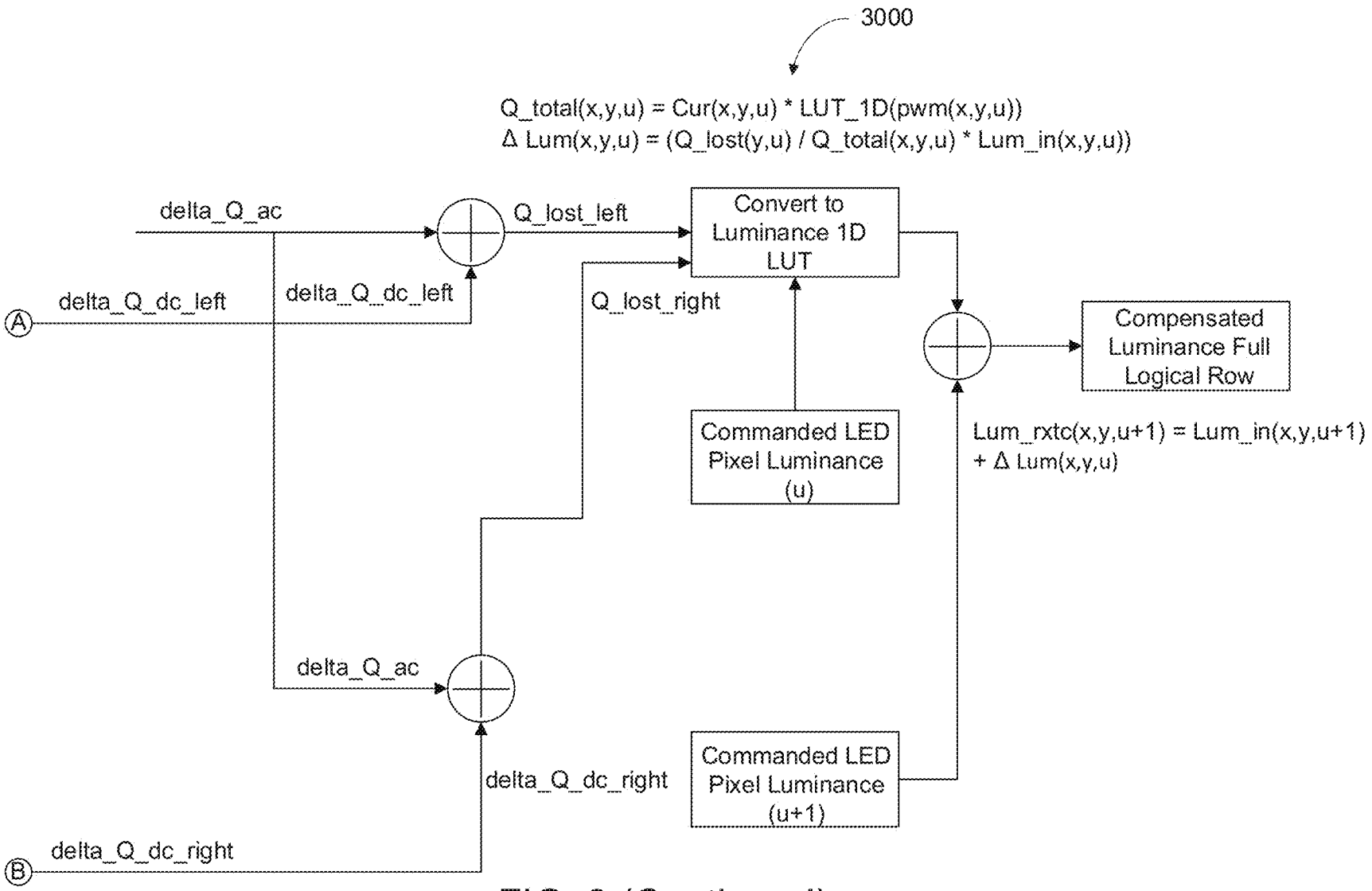
Figure 4:
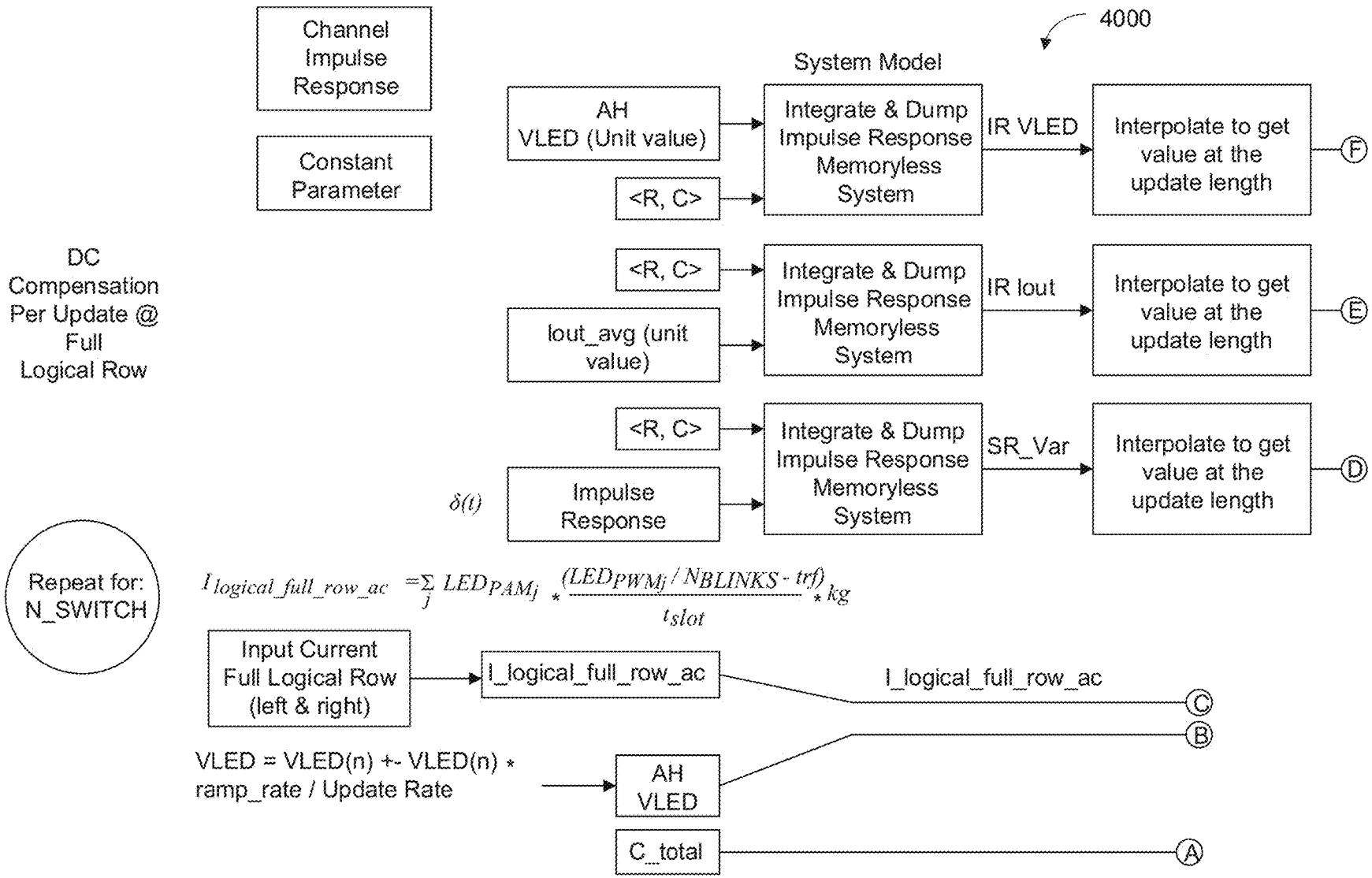
FIG. 4 is a block diagram of a row driver embodiment configured to provide alternating current compensation for crosstalk between rows of the LED device.
Figure 4:
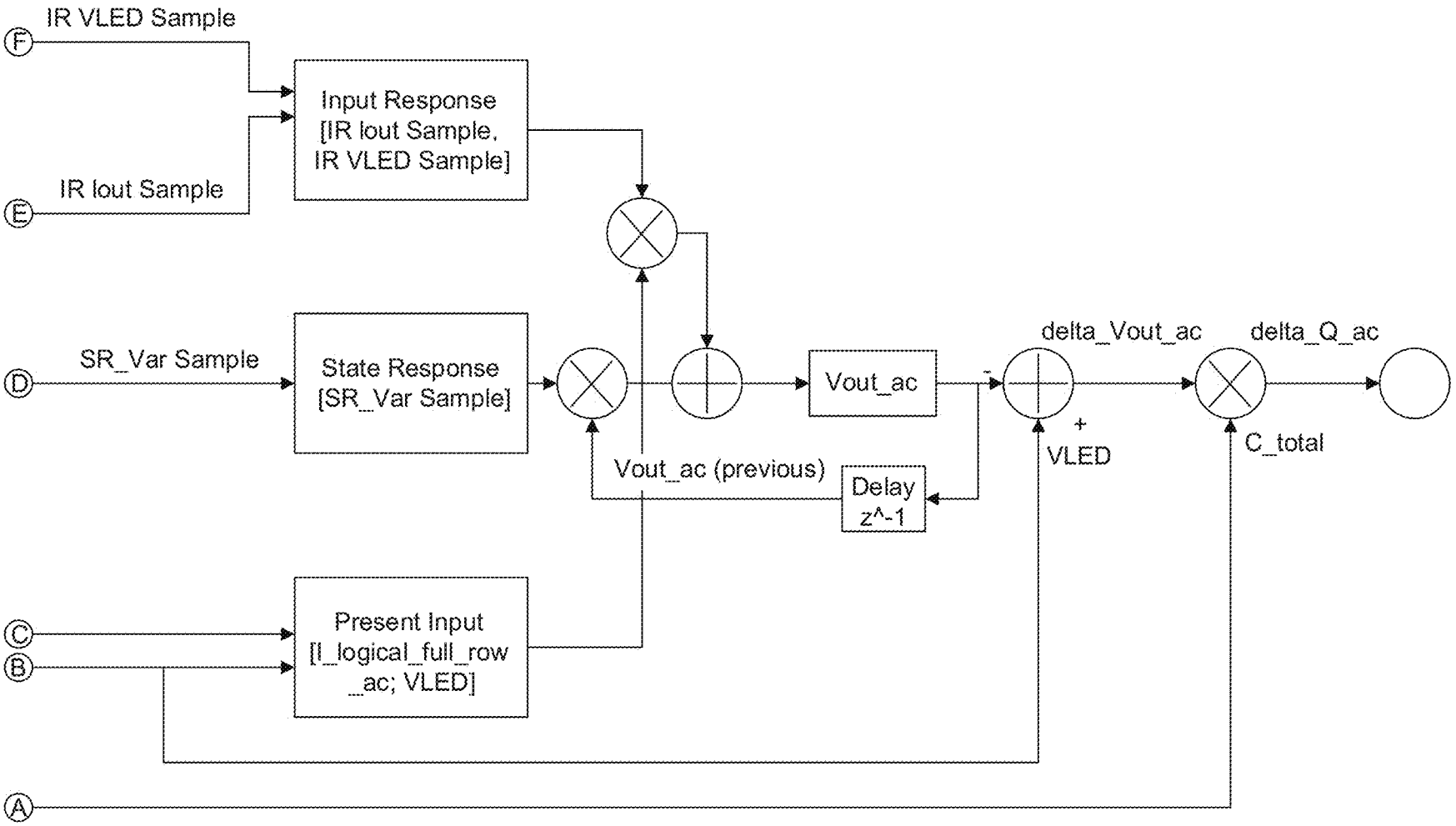
Figure 5:
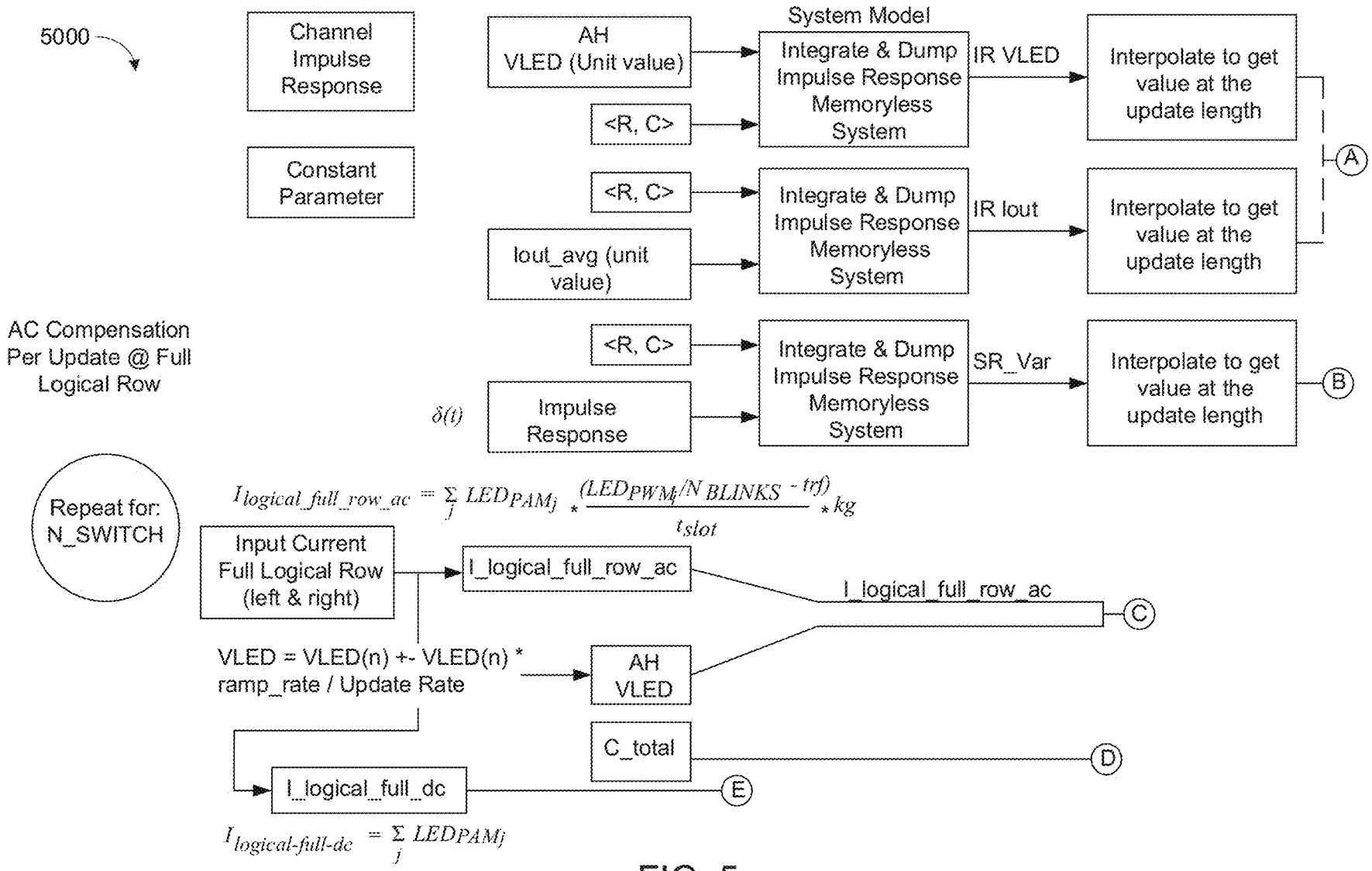
FIG. 5 is a block diagram of a row driver embodiment configured to provide full compensation for crosstalk between rows of the LED device.
Figure 5:
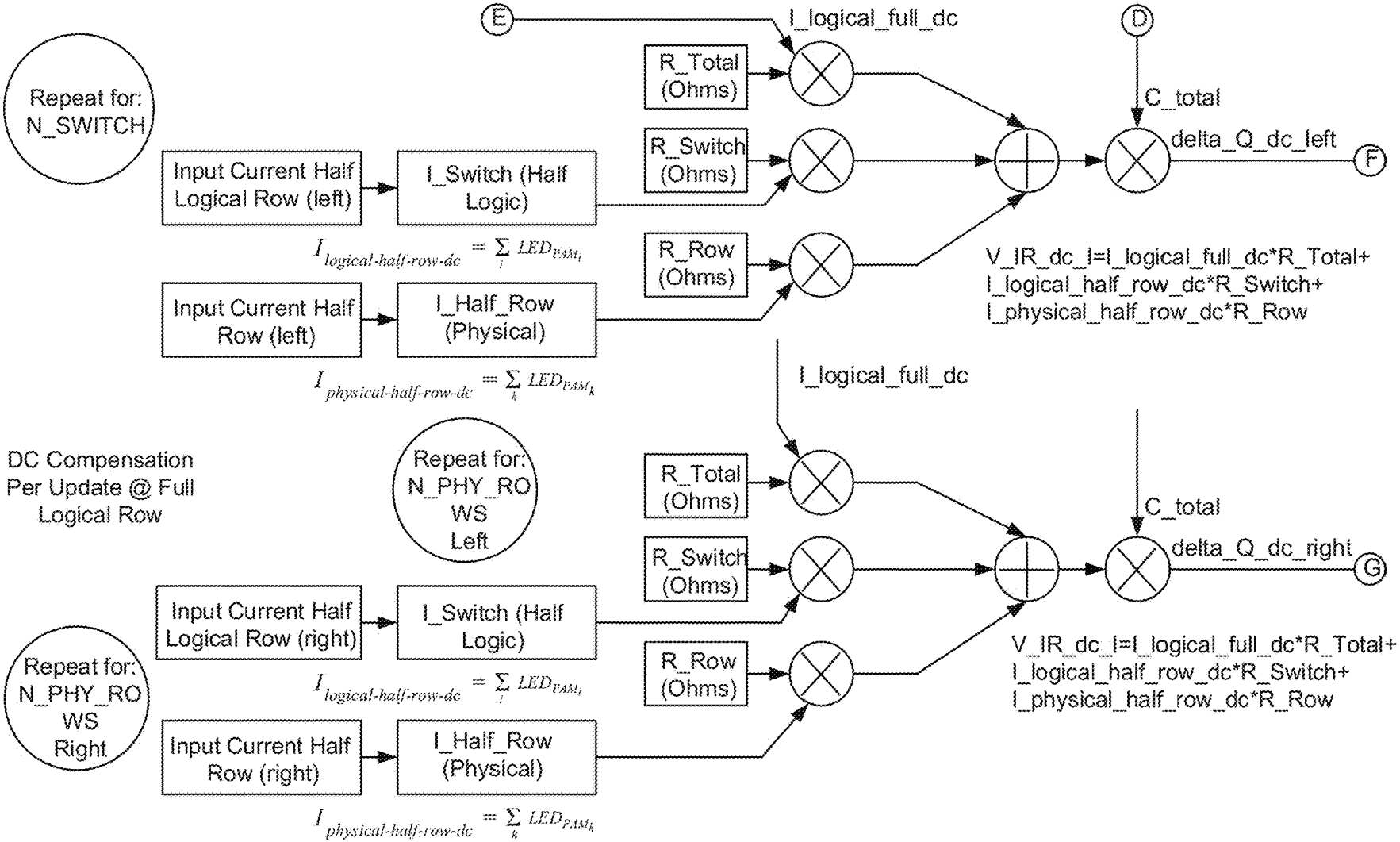
Figure 5:
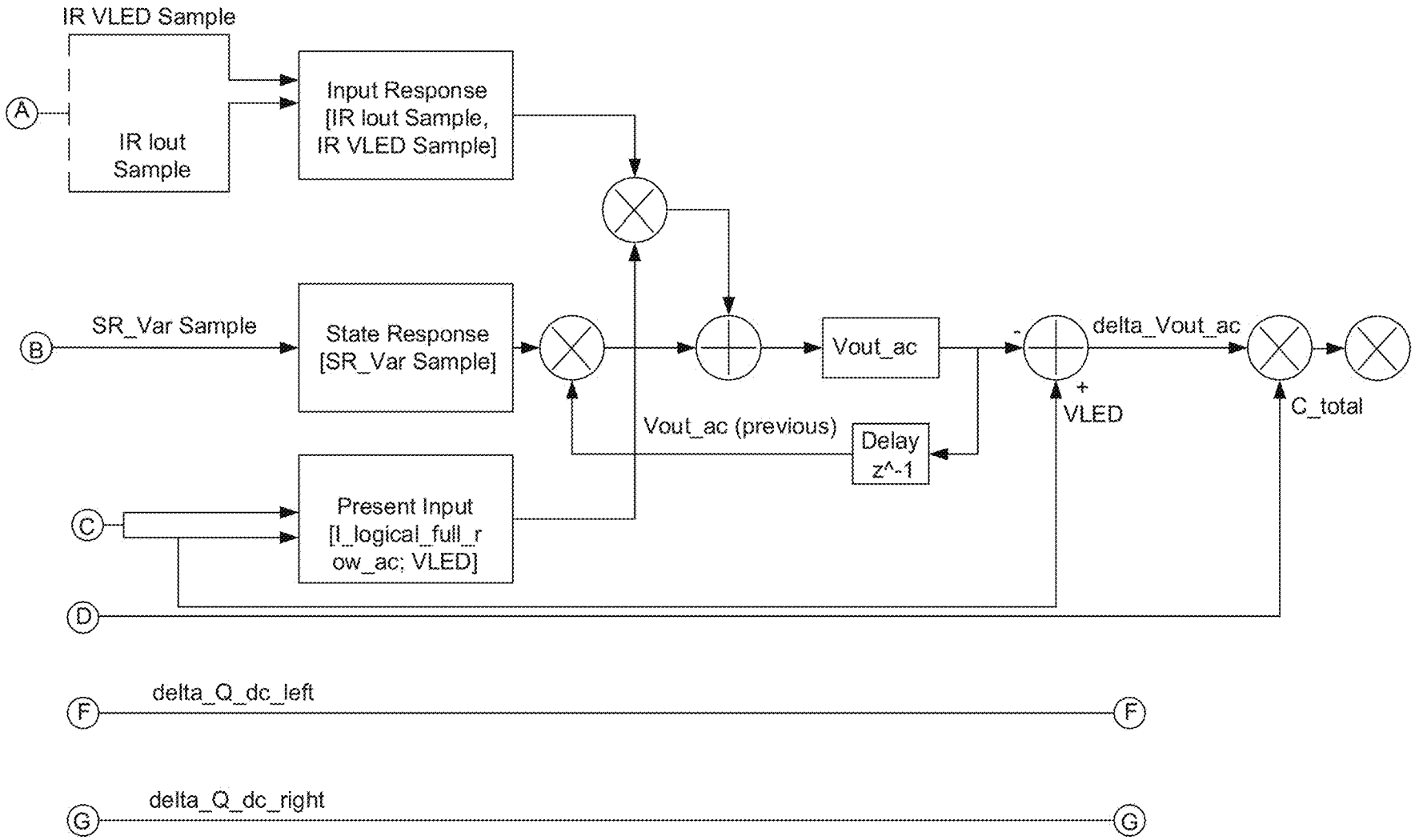
Figure 5:
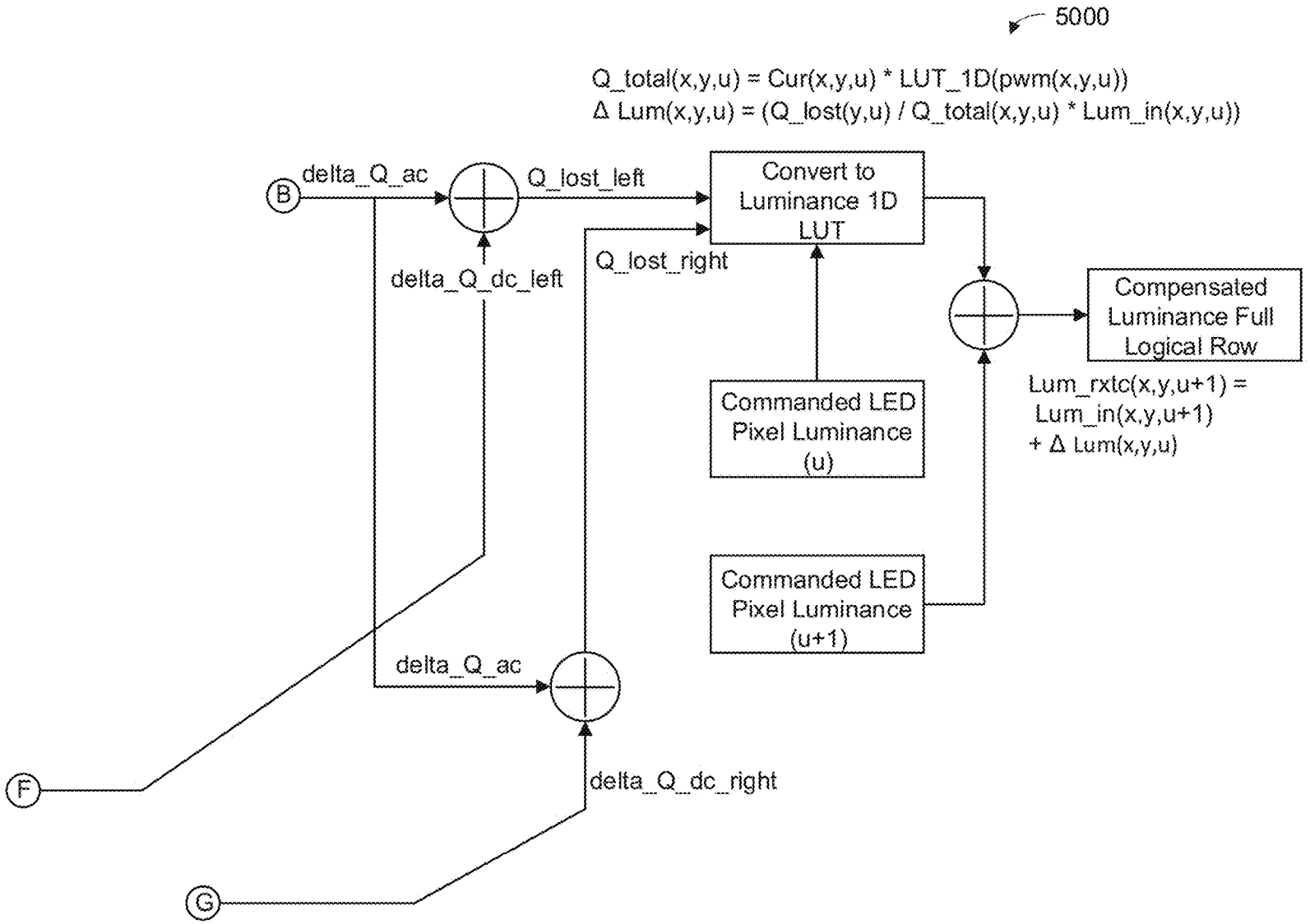

Moving to FIGS. 3-5, variations of row driver 2000 enable compensation for row crosstalk, applying compensation from sources: alternating current (AC) and direct current (DC). FIG. 3 depicts a DC compensation row driver 3000 embodiment based on IR drops, and reduces or eliminates luminance drops due to content-dependent $V_{LED}$ differences. FIG. 4 shows an AC compensation row driver 4000 embodiment based on voltage transients, reducing or eliminating luminance drop depending on a previous row's content. FIG. 5 illustrates a row driver 5000 embodiment that implements both AC and DC compensation. All three embodiments (3000, 4000, 5000) may also include compensation based on adaptive (dynamic) $V_{LED}$ headroom voltage tracking. It is understood by those familiar with the art that the system described herein may be implemented in a variety of hardware or firmware solutions. Some embodiments may be specialized integrated circuits, or implemented as a general purpose microprocessor with instructions stored on a non-transitory computer-readable storage medium encoded with data and instructions.

FIG. 3 is a functional diagram of a row driver 3000 embodiment configured to provide DC compensation for crosstalk between rows of the LED device, in accordance with an embodiment of the present disclosure.

DC compensation by row driver 3000 is based on voltage drops. The voltage drops are calculated using Ohm's Law using received current values multiplied by known resistances. The functionality may be described using the following pseudo-code:

```
WITH, I_logical_full_dc,
I_logical_half_left_row_dc, I_logical_half_left_row_dc, ,
I_physical_half_row_left_dc, I_physical_half_row_right_dc,
R_Total, R_Switch, and R_Row DO
    FOR EACH physical_row
        V_left_dc(physical_row_index) =
  I_logical_full_dc(physical_row_index) * R_Total +
  I_logical_half_left_row_dc(physical_row_index) *
  R_Switch(physical_row_index) +
  I_physical_half_row_left_dc(physical_row_index) *
  R_Row(physical_row_index)
        V_right_dc(physical_row_index) =
  I_logical_full_dc(physical_row_index) * R_Total +
  I_logical_half_right_row_dc(physical_row_index) *
  R_Switch(physical_row_index) +
  I_physical_half_row_right_dc(physical_row_index) *
  R_Row(physical_row_index)
    END
  END
```

Left and right are used to describe the number of row drivers, as described in FIG. 2, and the generalization to the use of more than two row drivers (left and right) helps simplify the calculation for the IR drop. It is understood that the currents and resistance values at each physical row may be different based on the implementation. The V_left_dc, and V_right_dc are the vectors representing the voltage drop due to direct current. V_dc is the combination of V_left_dc and V_right_dc IR drops. Then, with the capacitance C_total the calculation for the lost charge is as follows: V_dc*C_total.

The DC compensation row driver 3000 embodiment receives the peak or instantaneous current of the entire display panel 2100 for every row, including: input current full logical row (left and right) 3010*a*, input current half logical row (left) 3010*b*, input current half physical row (left) 3010*c*, input current half logical row (right) 3010*d*, and input current half physical row (right) 3010*e*. Logical rows may contain one or more physical rows. Input current can be calculated by summing the current for each LED pixel. For example, input current full logical row (left and right) 3010*a* can be calculated by summing the current for each LED pixel, $$I_{logical-full-dc} = \sum_j LED_{PAM_j}$$

Input current half logical row (left) 3010*b* may be calculated as, $$I_{logical-half-row-dc} = \sum_i LED_{PAM_i}$$

Input current half physical row (left) 3010*c* may be calculated as, $$I_{physical-half-row-dc} = \sum_k LED_{PAM_k}$$

Input current half logical row (right) 3010*d* may be calculated as, $$I_{logical-half-row-dc} = \sum_i LED_{PAM_i}$$

Input current half physical row (right) 3010*e* may be calculated as, $$I_{physical-half-row-dc} = \sum_k LED_{PAM_k}$$

where i, j, and k represent the number of LED pixels in half logical row (left or right), in full logical row (left and right), and in half physical row (left or right), respectively, and where $LED_{PAM}$ is the pulse amplitude of the corresponding LED pixel current. It is possible that left and right logical rows can have different number of LED pixels. Similarly, it is also possible that left and right physical rows can have different number of LED pixels. With this information, the instantaneous or peak current of the whole display panel 2100 for every slot duration could be calculated. The slot is the time during which one logical row is "on."

Total logical row resistance 3020*a*, half logical row (left) resistance 3020*b*, half physical row (left) resistance 3020*c*, half logical row (right) resistance 3020*d*, half physical row (right) resistance 3020*e* are known, and correspond to their respective input currents. It is understood that this resistive network is an example as depicted in FIG. 6. Depending upon the implementation, there could be more or less components in this network. For example, 3020*b/d* may be just switch resistance or switch resistance+ printed circuit board (PCB) parasitic resistance.

As the resistance that corresponds to each input current is known, the voltage for the right and left sides can be respectively calculated, and summed for the left and right sides as shown in FIG. 3. The change in voltage (ΔV) can therefore be calculated for each LED pixel.

Furthermore, as the total capacitance ($C_{total}$) per LED pixel is known, the charge loss ($\Delta Q_{loss}$) for each LED pixel can be determined using the relationship Q=C×V.

Using the charge loss ($\Delta Q_{loss}$) for each LED pixel, the corresponding change in luminance (Δlum %) is determined, and can then be compensated for by adjusting the current for each pixel based on calculated change in luminance for DC compensation.

FIG. 4 is a functional diagram of a row driver 4000 embodiment configured to provide alternating current compensation for crosstalk between rows of the LED device, in accordance with an embodiment of the present disclosure.

AC compensation by row driver 4000 is based on voltage transients, and uses the relationship:

$$v_{LED}(t) - v_{out}(t) - RC\frac{dv_{out}(t)}{dt} = RI_{out}$$

The functionality may be described using the following pseudo-code:

```
INITIALIZATION: [Previous State] = Initial VLED value
WITH, I_logical_full_row_ac, V_LED, response state(IR_I, IR_V_LED), N_CYCLES_2_STEADY_STATE, and Vac_pre DO
  FOR N_CYCLES_2_STEADY_STATE
  FOR EACH logical_full_row
  V_ac(logical_full_row_index) = [Input_Response] * [Present_Input] + [State_Response] * [Previous_State]
    END
  END
```

where:

[Input_Response]=[IR_I, IR_$V_{LED}$]→Row Vector

[Present_Input]=[I_logical_full_row_ac; $V_{LED}$]→Column vector

State_Response→Constant Value derived from the RC modeling of the switch

[Previous_State]→previous calculated V_ac for logical full row

The row vector, column vector, constant value and previous state are the vectors to calculate the voltage drop due to AC. Then, the difference between the $V_{LED}$ value and the V_ac is derived to calculate the lost charge.

As a reference a description of the state equations for the AC is included in the last slide of the attached presentation. There, you can see the relationship with the equation in the AC calculation.

Also, N_CYCLES_2_STEADY_STATE represents the number of times the calculation for each V_ac requires to reach its final value.

Row driver 4000 receives inputs including: current impulse response, average output current, and the adaptive headroom of the $V_{LED}$. As shown in FIG. 4, the average output current and the adaptive headroom of the $V_{LED}$ are used to calculate the input response of the LED pixel.

The impulse response of the LED (8 W) is used to calculate the state response of the LED pixel.

The input AC current full logical row (left and right) is used to determine present input averaged over one slot time. Input AC current can be calculated by summing average current per slot for each LED pixel, $$I_{logical-full-row-ac} = \sum_j LED_{PAM_j} * \frac{\left(\frac{LED_{PWM_j}}{N_{BLINKS}} - trf\right)}{t_{slot}} * \text{kg}$$

$LED_{PAM}$ is pulse amplitude of LED pixel current. $LED_{PWM}$ is pulse width of LED pixel current and $N_{BLINKS}$ is the number of pulses that each PWM pulse is represented with. trf is average of rise/fall times of LED pixel current pulse. For example, if rise time is x and fall time is y, then trf is (x+y)/2. $t_{slot}$ is one slot time in which only one logical row is on. kg is a static scaling factor that takes backlight driver and PCB characteristics into account and is implementation specific. With this information, the AC current of the whole display panel 2100 for every slot duration could be calculated.

As the input and state response parameters of display system 200 are known, the voltage transients for each full logical row (left and right) can be calculated as shown in FIG. 4.

Furthermore, as the total capacitance ($C_{total}$) of the display panel 2100 is known, the charge loss ($\Delta Q_{loss}$) for each LED pixel can be determined using the relationship Q=C×V.

During each backlight update, Vout for each full logical row (left and right) can be determined, and the resulting average $V_{LED}$ for each full logical row (left and right) is calculated.

Using the charge loss ($\Delta Q_{loss}$) for each LED pixel, the corresponding change in luminance (Δlum %) is determined, and can then be compensated for by adjusting the current for each pixel based on calculated change in luminance for AC compensation.

FIG. 5 is a functional diagram of a row driver 5000 embodiment. Row driver 5000 is configured to provide full compensation for crosstalk between rows of an LED device, in accordance with an embodiment of the present disclosure. Essentially row driver 5000 comprises the DC row driver 3000 of FIG. 3 and the AC row driver 4000 of FIG. 4 in a single embodiment.

DC compensation by row driver 5000 is based on voltage drops. The voltage drops are calculated using Ohm's Law using received current values multiplied by known resistances. The functionality may be described using the following pseudo-code:

```
WITH, I_logical_full_dc,
I_logical_half_left_row_dc, I_logical_half_left_row_dc, ,
I_physical_half_row_left_dc, I_physical_half_row_right_dc,
R_Total, R_Switch, and R_Row DO
    FOR EACH physical_row
      V_left_dc(physical_row_index) =
I_logical_full_dc(physical_row_index) * R_Total +
I_logical_half_left_row_dc(physical_row_index) *
R_Switch(physical_row_index) +
I_physical_half_row_left_dc(physical_row_index) *
R_Row(physical_row_index)
      V_right_dc(physical_row_index) =
I_logical_full_dc(physical_row_index) * R_Total +
I_logical_half_right_row_dc(physical_row_index) *
R_Switch(physical_row_index) +
I_physical_half_row_right_dc(physical_row_index) *
R_Row(physical_row_index)
    END
END
```

It is understood that the currents and resistance values at each physical row may be different based on the implementation. The V_left_dc, and V_right_dc are the vectors representing the voltage drop due to direct current. Then, with the capacitance C_total the calculation for the lost charge is as follows: V_dc*C_total.

The DC compensation row driver 5000 embodiment receives the peak or instantaneous current of the entire display panel 2100 for every row, including: input current full logical row (left and right), input current half logical row (left), input current half physical row (left), input current half logical row (right), and input current half physical row (right). Logical rows may contain one or more physical rows. Input current can be calculated by summing the current for each LED pixel. For example, input current full logical row (left and right) 3010*a* can be calculated by summing the current for each LED pixel, $$I_{logical-full-dc} = \sum_j LED_{PAM_j}$$

Input current half logical row (left) may be calculated as, $$I_{logical-half-row-dc} = \sum_i LED_{PAM_i}$$

Input current half physical row (left) may be calculated as, $$I_{physical-half-row-dc} = \sum_k LED_{PAM_k}$$

Input current half logical row (right) may be calculated as, $$I_{logical-half-row-dc} = \sum_i LED_{PAM_i}$$

Input current half physical row (right) may be calculated as, $$I_{physical-half-row-dc} = \sum_k LED_{PAM_k}$$

where i, j, and k represent the number of LED pixels in half logical row (left or right), in full logical row (left and right), and half physical row (left or right), respectively, and where $LED_{PAM}$ is the pulse amplitude of the corresponding LED pixel current. It is possible that left and right logical rows can have different number of LED pixels. Similarly, it is also possible that left and right physical rows can have different number of LED pixels. With this information, the instantaneous or peak current of the whole display panel 2100 for every slot duration could be calculated. The slot is the time during which one logical row is "on."

Total logical row resistance, half logical row (left) resistance, half physical row (left) resistance, half logical row (right) resistance, half physical row (right) resistance are known, and correspond to their respective input currents. It is understood that this resistive network is an example as depicted in FIG. 6. Depending upon the implementation, there could be more or less components in this network.

As the resistance that corresponds to each input current is known, the voltage for the right and left sides can be respectively calculated, and summed for the left and right sides as shown in FIG. 5. The change in voltage (ΔV) can therefore be calculated for each LED pixel.

Furthermore, as the total capacitance ($C_{total}$) per LED pixel is known, the charge loss ($\Delta Q_{loss}$) for each LED pixel can be determined using the relationship Q=C×V.

Using the charge loss ($\Delta Q_{loss}$) for each LED pixel, the corresponding change in luminance (Δlum %) is determined, and can then be compensated for by adjusting the current for each pixel based on calculated change in luminance for DC compensation.

AC compensation by row driver 5000 is based on voltage transients, and uses the relationship:

$$v_{LED}(t) - v_{out}(t) - RC\frac{dv_{out}(t)}{dt} = RI_{out}$$

The functionality may be described using the following pseudo-code:

```
INITIALIZATION: [Previous State] = Initial VLED value
    WITH, I_logical_full_row_ac, V_LED, response state(IR_I, IR_V_LED), N_CYCLES_2_STEADY_STATE, and Vac_pre DO
    FOR N_CYCLES_2_STEADY_STATE
    FOR EACH logical_full_row
    V_ac(logical_full_row_index) = [Input_Response] * [Present_Input] + [State_Response] * [Previous_State]
      END
    END
```

where:

[Input_Response]=[IR_I, IR_$V_{LED}$]→Row Vector

[Present_Input]=[I_logical_full_row_ac; $V_{LED}$]→Column vector

State_Response→Constant Value derived from the RC modeling of the switch

[Previous_State]→previous calculated V_ac for logical full row

The row vector, column vector, constant value and previous state are the vectors to calculate the voltage drop due to AC. Then, the difference between the $V_{LED}$ value and the V_ac is derived to calculate the lost charge.

Row driver 5000 receives inputs including: current impulse response, average output current, and the adaptive headroom of the $V_{LED}$. As shown in FIG. 5, the peak or instantaneous output current and the adaptive headroom of the $V_{LED}$ are used to calculate the input response of the LED pixel.

The impulse response of the LED (8 W) is used to calculate the state response of the LED pixel.

The input AC current full logical row (left and right) is used to determine present input averaged over one slot time. Input AC current can be calculated by summing average current per slot for each LED pixel, $$I_{logical-full-row-ac} = \sum_j LED_{PAM_j} * \frac{\left(\frac{LED_{PWM_j}}{N_{BLINKS}} - trf\right)}{t_{slot}} * \text{kg}$$

$LED_{PAM}$ is pulse amplitude of LED pixel current. $LED_{PWM}$ is pulse width of LED pixel current and $N_{BLINKS}$ is the number of pulses that each PWM pulse is represented with. trf is average of rise/fall times of LED pixel current pulse. For example, if rise time is x and fall time is y, then trf is (x+y)/2. $t_{slot}$ is one slot time in which only one logical row is on. kg is a static scaling factor that takes backlight driver and PCB characteristics into account and is implementation specific. With this information, the AC current of the whole display panel 2100 for every slot duration could be calculated.

As the input and state response parameters of display system 200 are known, the voltage transients for each full logical row (left and right) can be respectively calculated as shown in FIG. 5.

Furthermore, as the total capacitance ($C_{total}$) of the display panel 2100 is known, the charge loss ($\Delta Q_{loss}$) for each LED pixel can be determined using the relationship Q=C×V.

During each backlight update, Vout for each full logical row (left and right) can be determined, and the resulting peak or instantaneous $V_{LED}$ for each full logical row (left and right) is calculated.

Using the charge loss ($\Delta Q_{loss}$) for each LED pixel, the corresponding change in luminance (Δlum %) is determined, and can then be compensated for by adjusting the current for each pixel based on calculated change in luminance for AC compensation.

The previous description of the embodiments is provided to enable any person skilled in the art to practice the disclosure. The various modifications to these embodiments will be readily apparent to those skilled in the art, and the generic principles defined herein may be applied to other embodiments without the use of inventive faculty. Thus, the present disclosure is not intended to be limited to the embodiments shown herein, but is to be accorded the widest scope consistent with the principles and novel features disclosed herein.

Figure 7:
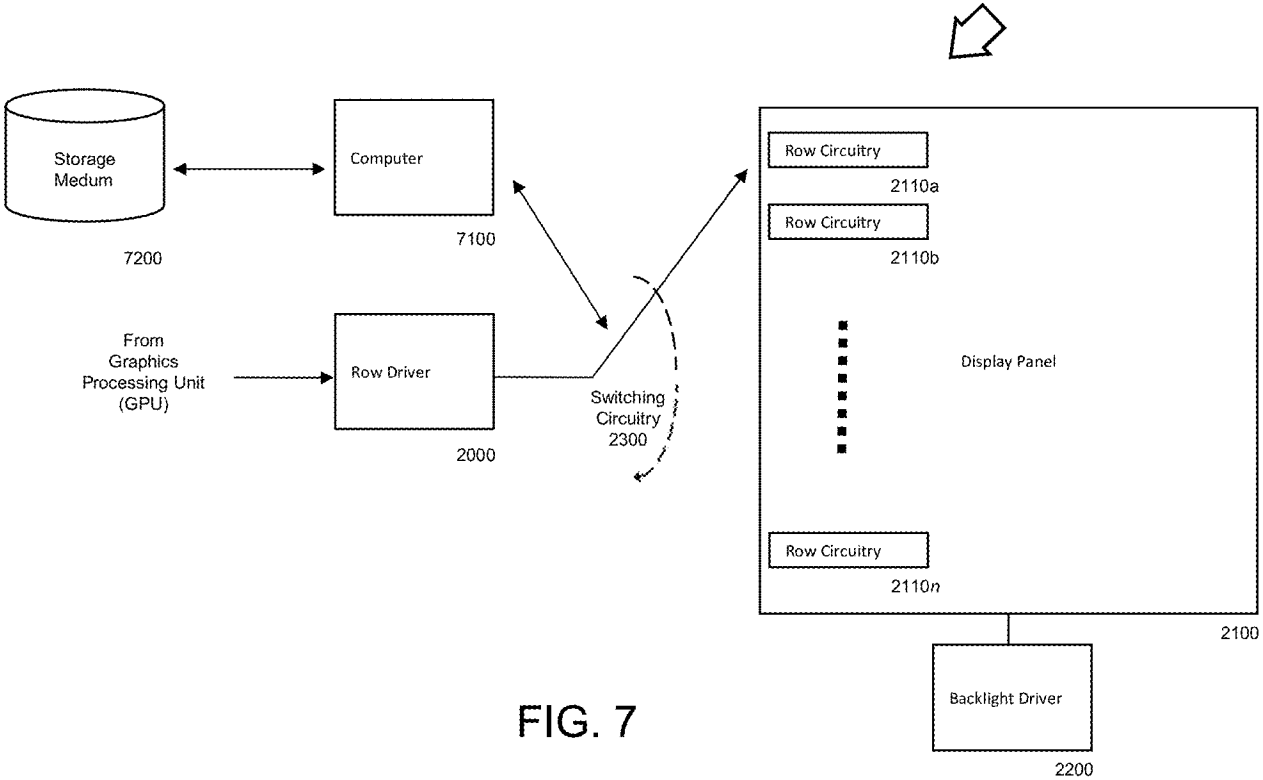
FIG. 7 is a block diagram of an alternate display system embodiment configured to provide compensation for crosstalk between rows of the LED device.

In a non-transitory computer-readable storage medium embodiment, shown in FIG. 7, a display system 200 includes a storage medium 7200 is encoded with data and instructions to be executed by a computer 7100. The display system 200 further comprises a light emitting diode (LED) display panel 2100, a row driver 200, and switching circuitry 2300. The light emitting diode (LED) display panel 2100 comprises a plurality of light emitting pixels divided into rows 2100*a-n*. The rows of light emitting pixels 2100*a-n* each further divided into at least one region. The row driver 2000 is configured to receive image data from a graphics-processing unit. The row driver 2000 is configured to compensate for crosstalk between the rows of light emitting pixels, and to output crosstalk compensated image data. The switching circuitry 2300 is configured to receive the crosstalk compensated image data and configured to route the crosstalk compensated image data to the display panel for display. The light-emitting diode display panel 2100 may be incorporated in a tablet computer, mobile phone, augmented reality display, notebook computer, computer display, or digital watch 200.

What is claimed is:

1. An apparatus comprising:

a light emitting diode (LED) display panel comprising a plurality of light emitting pixels divided into rows, the rows of light emitting pixels each further divided into at least one region;

a row driver is configured to receive image data from a graphics processing unit, the row driver is configured to compensate for crosstalk between the rows of light emitting pixels using direct current (DC) compensation for crosstalk, the direct current compensation for crosstalk further comprising:

calculating peak current for each LED pixel of the display panel;

using the peak current for each pixel to calculate a DC change in $V_{LED}$ ($\Delta V_{DC}$) for that LED pixel for every backlight update;

using $\Delta V_{DC}$ for each LED pixel to calculate a charge loss ($\Delta Q_{loss_DC}$) for that LED pixel;

using $\Delta Q_{loss_DC}$ for each LED pixel to calculate a change in luminance (Δlum $\%_{_DC}$) for that LED pixel;

adjusting the peak current for each LED pixel based on Δlum $\%_{_DC}$ for that LED pixel;

and the row driver is further configured, to output crosstalk compensated image data;

switching circuitry configured to receive the crosstalk compensated image data and configured to route the crosstalk compensated image data to the display panel for display.

2. The apparatus of claim 1 wherein the apparatus is a tablet computer, mobile phone, augmented reality display, notebook computer, computer display, or digital watch.

3. A method comprising:

receiving image data from a graphics-processing unit by a row driver;

compensating for crosstalk between rows of light emitting pixels in a display panel by the row driver using direct current (DC) compensation for crosstalk, the direct current compensation for crosstalk further comprising:

calculating a peak current for each LED pixel of the display panel;

using the peak current for each pixel to calculate a DC change in $V_{LED}$ ($\Delta V_{DC}$) for that LED pixel for every backlight update;

using $\Delta V_{DC}$ for each LED pixel to calculate a charge loss ($\Delta Q_{loss_DC}$) for that LED pixel;

using $\Delta Q_{loss_DC}$ for each LED pixel to calculate a change in luminance ($\Delta$lum $\%_{_DC}$) for that LED pixel;

adjusting the peak current for each LED pixel based on $\Delta$lum $\%_{_DC}$ for that LED pixel;

outputting crosstalk compensated image data to switching circuitry;

receive the crosstalk compensated image data by the switching circuitry; and, routing the crosstalk compensated image data to the display panel for display.

4. The method of claim 3 wherein the display panel is incorporated in a tablet computer, mobile phone, augmented reality display, notebook computer, computer display, or digital watch.

5. A non-transitory computer-readable storage medium encoded with data and instructions, when read by a computer causes the computer to:

receive image data from a graphics-processing unit by a row driver;

compensate for crosstalk between rows of light emitting pixels in a display panel by the row driver using direct current (DC) compensation for crosstalk, the direct current compensation further comprising:

calculating a peak current for each LED pixel of the display panel;

using the peak current for each pixel to calculate a DC change in $V_{LED}$ ($\Delta V_{DC}$) for that LED pixel for every backlight update;

using $\Delta V_{DC}$ for each LED pixel to calculate a charge loss ($\Delta Q_{loss_DC}$) for that LED pixel;

using $\Delta Q_{loss_DC}$ for each LED pixel to calculate a change in luminance ($\Delta$lum $\%_{_DC}$) for that LED pixel;

adjusting the peak current for each LED pixel based on $\Delta$lum % DC for that LED pixel;

output crosstalk compensated image data to switching circuitry;

receive the crosstalk compensated image data by the switching circuitry; and, route the crosstalk compensated image data to the display panel for display.

6. The non-transitory computer-readable storage medium of claim 5 wherein the display panel is incorporated in a tablet computer, mobile phone, augmented reality display, notebook computer, computer display, or digital watch.

7. An apparatus comprising:

a light emitting diode (LED) display panel comprising a plurality of light emitting pixels divided into rows, the rows of light emitting pixels each further divided into at least one region;

a row driver is configured to receive image data from a graphics processing unit, the row driver is configured to compensate for crosstalk between the rows of light emitting pixels using alternating current (AC) compensation for crosstalk, the alternating current compensation for crosstalk further comprising:

using an average current to calculate AC output voltage ($Vout_{_AC}$) for each of the rows for every backlight update;

using $Vout_{_AC}$ to calculate a AC change in $V_{LED}$ ($\Delta V_{AC}$) for each of the rows;

using $\Delta V_{AC}$ to calculate a charge loss ($\Delta Qloss_{_DC}$) for each LED pixel;

using $\Delta Qloss_{_AC}$ for each LED pixel to calculate a change in luminance ($\Delta$lum $\%_{_AC}$) for that LED pixel;

adjusting the average current for each LED pixel based on $\Delta$lum $\%_{_AC}$ for that LED pixel;

and the row driver is further configured to output crosstalk compensated image data;

switching circuitry configured to receive the crosstalk compensated image data and configured to route the crosstalk compensated image data to the display panel for display.

8. The apparatus of claim 7 wherein the apparatus is a tablet computer, mobile phone, augmented reality display, notebook computer, computer display, or digital watch.

9. A method comprising:

receiving image data from a graphics-processing unit by a row driver;

compensating for crosstalk between rows of light emitting pixels in a display panel by the row driver using alternating current (AC) compensation for crosstalk, the alternating current compensation for crosstalk further comprising:

using an average current to calculate AC output voltage ($Vout_{_AC}$) for each of the rows for every backlight update;

using $Vout_{_AC}$ to calculate a AC change in $V_{LED}$ ($\Delta V_{AC}$) for each of the rows;

using $\Delta V_{AC}$ to calculate a charge loss ($\Delta Qloss_{_AC}$) for each LED pixel;

using $\Delta Qloss_{_AC}$ for each LED pixel to calculate a change in luminance (Alum $\%_{_AC}$) for that LED pixel;

adjusting the average current for each LED pixel based on $\Delta$lum % AC for that LED pixel;

outputting crosstalk compensated image data to switching circuitry;

receive the crosstalk compensated image data by the switching circuitry; and, routing the crosstalk compensated image data to the display panel for display.

10. The method of claim 9 wherein the display panel is incorporated in a tablet computer, mobile phone, augmented reality display, notebook computer, computer display, or digital watch.

11. A non-transitory computer-readable storage medium encoded with data and instructions, when read by a computer causes the computer to:

receive image data from a graphics-processing unit by a row driver;

compensate for crosstalk between rows of light emitting pixels in a display panel by the row driver using alternating current (AC) compensation for crosstalk, the alternating current compensation for crosstalk further comprising;

using an average current to calculate AC output voltage (Vout_AC) for each of the rows for every backlight update;

using $Vout_{_AC}$ to calculate a AC change in $V_{LED}$ ($\Delta V_{AC}$) for each of the rows;

using $\Delta V_{AC}$ to calculate a charge loss ($\Delta Qloss_{_AC}$) for each LED pixel;

using $\Delta Qloss_{_AC}$ for each LED pixel to calculate a change in luminance ($\Delta lum\ \%_{_AC}$) for that LED pixel;

adjusting the average current for each LED pixel based on $\Delta lum\ \%_{_AC}$ for that LED pixel;

output crosstalk compensated image data to switching circuitry;

receive the crosstalk compensated image data by the switching circuitry; and, route the crosstalk compensated image data to the display panel for display.

12. The non-transitory computer-readable storage medium of claim 11 wherein the display panel is incorporated in a tablet computer, mobile phone, augmented reality display, notebook computer, computer display, or digital watch.

* * * * *